United States Patent [19]

Holt

[11] Patent Number: 4,812,824

[45] Date of Patent: Mar. 14, 1989

[54] PENDULUM ALARM SENSOR

[75] Inventor: William Holt, Wilmington, Del.

[73] Assignee: Alarm Accessory, Ltd., Claymont, Del.

[21] Appl. No.: 106,381

[22] Filed: Oct. 9, 1987

[51] Int. Cl.[4] ..... G08B 13/02; G08B 13/08

[52] U.S. Cl. ..... 340/566; 200/61.93; 340/545

[58] Field of Search ..... 340/566, 545; 200/61.93

[56] References Cited

U.S. PATENT DOCUMENTS

| | | | |
|---|---|---|---|
| 1,099,777 | 6/1914 | Sundel | 340/546 |
| 2,884,623 | 4/1959 | Stelter | 340/566 |
| 3,192,251 | 6/1965 | Werlin | 340/566 |
| 3,725,896 | 4/1973 | Wagner | 340/689 |
| 4,227,188 | 10/1980 | Peterson | 340/566 |
| 4,575,713 | 3/1986 | Piper | 340/546 |

*Primary Examiner*—Glen R. Swann, III

*Attorney, Agent, or Firm*—Mortenson & Uebler

[57] ABSTRACT

A housing contains a mercury tilt switch in electrical connection with an alarm circuit and has two, relatively long, highly flexible insulated lead wires extending from the tilt switch and housing and being in electrical connection with an alarm within the circuit. The lead wires support the housing containing the switch and extend upwardly therefrom to a support affixed to a window frame or the like, and then are connected to the alarm. The lead wires are at least ten feet long, preferably about fifteen feet long, with the housing and switch being supported by the lead wires in pendulum-like fashion adjacent to, but not contacting, the window. When a disturbance such as an intruder enters the window, the pendulum-like apparatus is disturbed and the alarm is sounded.

5 Claims, 1 Drawing Sheet

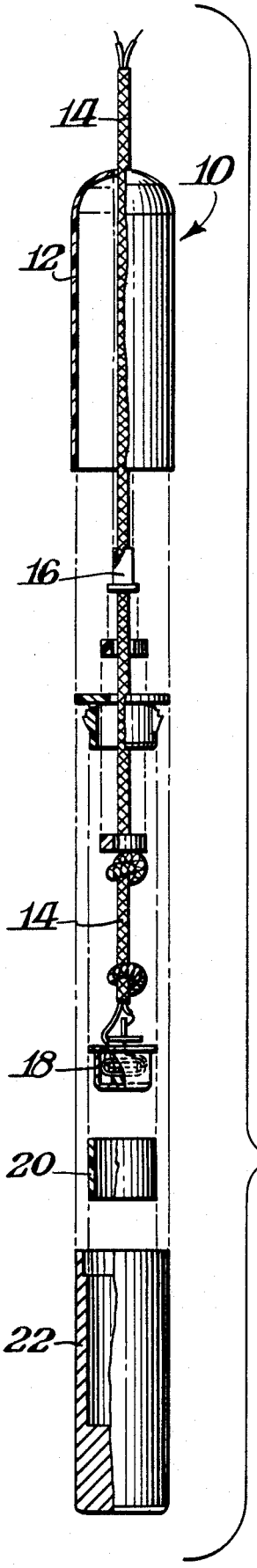
Fig. 1.
Fig. 2.
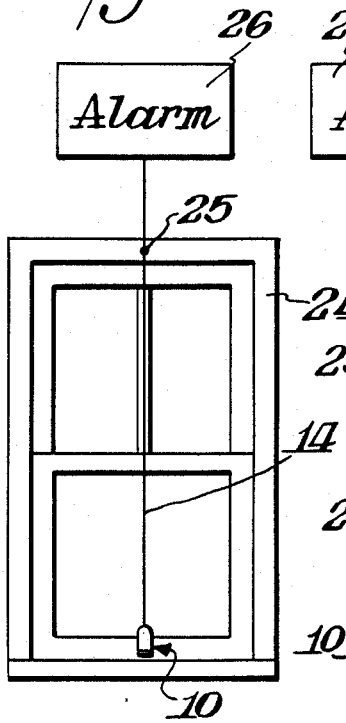
Fig. 3.
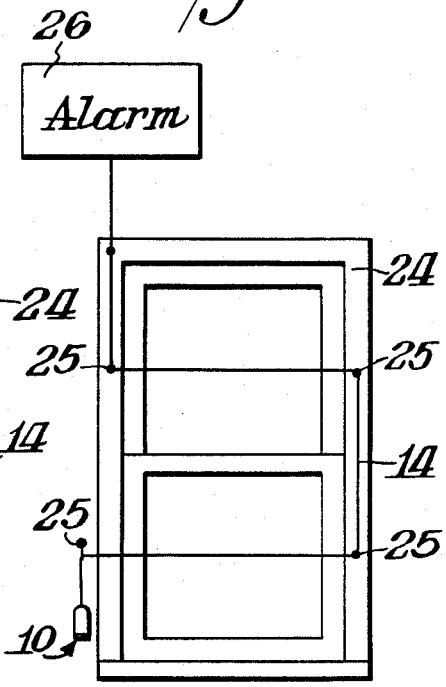
Fig. 4.
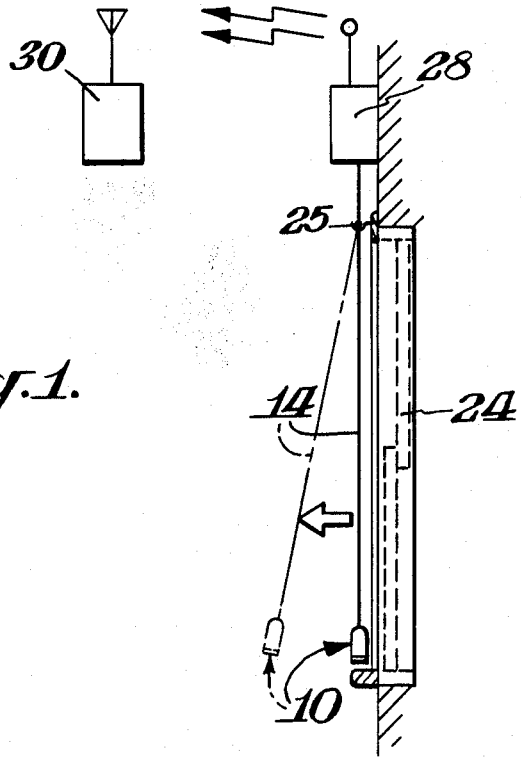

PENDULUM ALARM SENSOR

BACKGROUND OF THE INVENTION

This invention relates to an alarm sensor for sounding an alert upon attempted entry by an intruder through perimeter entry points of a building such as windows.

Many different types of alarm switches and sensors for protecting perimeter entry points are known such as magnetic reed switches, mercury switches, glass breakage sensors, vibration sensors, shock sensors and numerous other switches and wire traps.

Other alarm systems are known which employ pendulums or pendulumlike devices. U.S. Pat. No. 4,575,713 discloses a disturbance alarm comprising a hollow tubular case having upper and lower electrical contact plates fixedly positioned therein. A pendulum assembly includes a lower weight which rests upon the flat upper surface of the lower contact plate, an upper weight and a rigid shaft fixed to the weights and spacing the weights from each other. The upper electrical contact plate encircles the pendulum shaft and is adapted to make electrical contact therewith to close an electrical circuit through an alarm device. A collar is slidable within the case for clamping the lower weight onto the contact plate such that the pendulum is balanced thereon out of electrical contact with the upper contact plate. A magnet encircles the pendulum shaft adjacent to the upper weight for attracting and holding the pendulum in electrical contact with the upper plate when such balance is disturbed and an alarm condition is thereby detected.

U.S. Pat. No. 4,227,188 discloses an intrusion alarm system which utilizes an inertially responsive sensor preferably present as a pendulum actuated reed switch. Logic circuits provided within the system provide an efficient pulsating alarm at dual frequencies optimized for human recognition. In both arrangements, a unique dual delay is provided, one delay commencing with the arming of the device to permit adequate time for the setting of a sensing switch. A second delay arrangement is provided at the option of the operator for purposes of delaying the activation of the alarm once the sensor switch has been tripped. This feature may be utilized to permit entrance through a door or the like upon which the unit is mounted wherein the device can be deactivated prior to assuming an alarm sounding condition. One embodiment provides for achieving a "beat" form of loudspeaker drive through the use of a first oscillator which is modulated by a network including an R-C timing circuit coupled with a trigger exhibiting a hysteresis triggering characteristic.

U.S. Pat. No. 3,725,896 discloses an alarm device which sounds an audio alarm when it is moved to a predetermined position. The alarm includes a magnetic latching pendulum switch which is normally open but which is closed to energize the alarm when the device falls onto its back portion. A dial lock means is also provided for preventing the pendulum switch from being manually opened until the proper number has been dialed thereon. The device may be used in conjunction with inwardly or outwardly swinging doors, and vertically or horizontally sliding windows. Means are also disclosed for positioning the device with respect to inwardly swinging doors and horizontally sliding windows or doors.

U.S. Pat. No. 1,099,777 discloses a portable burglar alarm for use by travelers. The alarm comprises a casing provided with an electricallyactuated alarm and adapted to be temporarily or permanently fastened to a door, window or other movable part, a circuit closer for the alarm and arranged within the casing, the circuit closer having a fixed contact and a spring-pressed contact lever adapted to engage the contact to close the circuit for the alarm, a flexible connection connected with the contact lever and extending to the outside of the casing, and retaining means fixed on a stationary part adjacent the movable part and engaged by the flexible connection to hold the contact lever normally out of engagement with the fixed contact and to release the contact lever on movement of the movable part.

SUMMARY OF THE INVENTION

An alarm sensor is provided comprising a housing containing a mercury tilt switch in electrical connection with an alarm circuit. Two highly flexible insulated lead wires extend from the tilt switch and housing and are in electrical connection with alarm means within the circuit. The lead wires also support the housing containing the switch and extend upwardly therefrom to a support affixed to a window frame or the like, and thence to an alarm. The lead wires are at least ten feet long. The housing and switch are supported by the lead wires in pendulum-like fashion adjacent to, but not contacting, the window. When a disturbance such as an intruder enters the window, the housing and switch are disturbed and the alarm is sounded. The lead wires are preferably approximately fifteen feet long. The alarm circuit can be normally open or normally closed. The alarm circuit may include radio transmitting means in proximity to the window and radio receiving means in proximity to the alarm, whereby any disturbance sounds the alarm at a location remote from the window.

BRIEF DESCRIPTION OF THE DRAWINGS

FIG. 1 is an exploded elevational view, partly broken away, showing the several components of the alarm sensor according to the invention.

FIG. 2 is a front elevational view of the pendulum-like alarm actuating apparatus according to the invention affixed to a window.

FIG. 3 is a front elevational view of another embodiment of the pendulum-like alarm actuating apparatus according to the invention affixed to a window.

FIG. 4 is a side elevational representation showing the sensor apparatus attached to a window and connected to a radio transmitter which sends a radio signal to a remote receiver connected to an alarm when the sensor is disturbed (shown in phantom) and the alarm sounds.

DETAILED DESCRIPTION OF THE INVENTION AND PREFERRED EMBODIMENTS WITH REFERENCE TO THE DRAWINGS

An alarm sensor is provided comprising a housing containing a mercury tilt switch in electrical connection with an alarm circuit and having two, relatively long, highly flexible insulated lead wires extending from the tilt switch and housing and being in electrical connection with an alarm within the circuit. The lead wires support the housing containing the switch and extend upwardly therefrom to a support affixed to a window frame or the like, and thence are connected to the alarm. The lead wires are at least ten feet long, preferably about fifteen feet long, with the housing and switch being supported by the lead wires in pendulum-like fashion adjacent to, but not contacting, the window. When a disturbance such as an intruder enters the window, the pendulum-like apparatus is disturbed and the alarm is sounded.

The alarm sensor according to the invention is unique in that the switch mechanism is suspended in mid-air, and does not touch or attach to any surface. This provides advantages over prior sensors that need to be screwed, glued or otherwise fastened to the window glass or window frame.

Because the sensor is suspended in mid-air not touching any surface, the switch mechanism is insulted from false-alarm-causing shocks or vibrations produced by normal environmental factors such as window rattle caused by passing trucks, wind, loose windows, birds, etc. The hanging sensor of the invention eliminates the need for sophisticated and expensive filters to screen out such nuisance alarms.

The sensor is inexpensive and is easily and quickly installed. Because the sensor is not attached to any moving part of the window, the user has complete freedom to open and close the window and no special take-off devices are required to enable the window to open without sounding the alarm. Gentle swaying, up to 20 degrees from vertical, will generally not trigger the alarm.

A detailed description of the invention and preferred embodiments is best provided by reference to the drawings wherein FIG. 1 is an exploded elevational view of the apparatus 10 according to the invention, partly broken away. Therein apparatus 10 comprises housing 12 from which extend insulated lead wires 14. The housing 12 contains top insulating spacer 16, a mercury tilt switch 18, bottom insulating spacer 20 and plug 22, which preferably is a brass plug to provide additional weight for the pendulum-like device.

Operation of the pendulum alarm is depicted in FIGS. 2, 3 and 4. In FIG. 2, the pendulum device 10 is suspended from the top of window 24 and hangs from clamp 25 hanging adjacent to, but not touching, the window. The tilt switch is in electrical connection, in either closed circuit or open circuit, as desired, with an alarm. When an intruder opens the window 24, the pendulum device 10 is swung away from the window and the mercury tilt switch is triggered by the disturbance, completing the necessary circuit, and the alarm sounds.

FIG. 3 shows an alternate configuration for hanging the device 10 adjacent to a window 24. Therein the flexible wire 14 is caused to pass horizontally over the upper and lower halves of window 24, held in place by clamps 25, the device 10 containing the mercury tilt switch being in electrical connection with the alarm as shown. Many such alternate configurations of the device 10, wire 14 and alarm are possible, as will be clear to one skilled in this art.

FIG. 4 shows a side elevation of the device 10 hanging from hook 25 adjacent to, but not in contact with, window 24. The alarm means is depicted as a radio transmitter 28 and remote radio receiver and alarm means 30. When the device is disturbed as depicted by the arrow, device 10 is tilted as shown in phantom, the electrical circuitry is completed sounding the alarm at a remote location.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An alarm sensor comprising a housing containing a mercury tilt switch in electrical connection with an alarm circuit, two highly flexible insulated lead wires extending from said tilt switch and housing and being in electrical connection with alarm means within said circuit, said lead wires also supporting said housing containing said switch and extending upwardly therefrom to a support affixed to a window frame or the like, and thence connected to said alarm circuit, said lead wires being at least ten feet long, said housing and switch being supported by said lead wires in pendulum-like fashion adjacent to, but not contacting, a window within said frame, whereby, when a disturbance occurs such as an intruder entering said window, said housing and switch are disturbed and said alarm is sounded.

2. The sensor of claim 1 wherein said lead wires are approximately fifteen feet long.

3. The sensor of claim 1 wherein said alarm circuit is normally open and is closed by disturbance of said switch, thereby sounding said alarm.

4. The sensor of claim 1 wherein said alarm circuit is normally closed and is opened by disturbance of said switch, thereby sounding said alarm.

5. The sensor of claim 1 wherein said alarm circuit includes radio transmitting means in proximity to said window and radio receiving means in proximity to said alarm, whereby said disturbance sounds said alarm at a location remote from said window.

* * * * *

UNITED STATES PATENT AND TRADEMARK OFFICE

CERTIFICATE OF CORRECTION

PATENT NO. : 4,812,824

DATED : March 14, 1989

INVENTOR(S) : William Holt

It is certified that error appears in the above-identified patent and that said Letters Patent is hereby corrected as shown below:

In the Abstract, line 8, please change "then" to --thence—.

In col. 1, line 14, please change "pendulumlike" to --pendulum-like—.

In col. 2, line 1, please change "electricallyactuated" to --electrically-actuated—.

In col. 3, line 14, please change "insulted" to --insulated—.

Signed and Sealed this

Seventeenth Day of October, 1989

*Attest:*

DONALD J. QUIGG

*Attesting Officer*

*Commissioner of Patents and Trademarks*